US009683455B2

(12) United States Patent
Povey et al.

(10) Patent No.: US 9,683,455 B2
(45) Date of Patent: Jun. 20, 2017

(54) COMPONENT FOR USE IN RELEASING A FLOW OF MATERIAL INTO AN ENVIRONMENT SUBJECT TO PERIODIC FLUCTUATIONS IN PRESSURE

(71) Applicant: ROLLS-ROYCE PLC, London (GB)

(72) Inventors: Thomas Povey, Oxford (GB); Matthew Christopher John Collins, Oxford (GB)

(73) Assignee: ROLLS-ROYCE PLC, London (GB)

( * ) Notice: Subject to any disclaimer, the term of this patent is extended or adjusted under 35 U.S.C. 154(b) by 674 days.

(21) Appl. No.: 14/309,745

(22) Filed: Jun. 19, 2014

(65) Prior Publication Data

US 2015/0247423 A1 Sep. 3, 2015

(30) Foreign Application Priority Data

Jun. 26, 2013 (GB) ..... 1311333.7

(51) Int. Cl.
*F01D 25/12* (2006.01)
*F01D 5/18* (2006.01)
(Continued)

(52) U.S. Cl.
CPC ..... *F01D 25/12* (2013.01); *F01D 5/186* (2013.01); *F01D 9/04* (2013.01); *F01D 11/08* (2013.01);
(Continued)

(58) Field of Classification Search
CPC ..... F01D 25/12; F01D 25/14; F01D 5/186; F01D 9/023; F01D 9/04; F01D 11/08;
(Continued)

(56) References Cited

U.S. PATENT DOCUMENTS 4,497,610 A 2/1985 Richardson et al.
6,196,792 B1 3/2001 Lee et al.
(Continued)

FOREIGN PATENT DOCUMENTS

DE 102011054880 A1 5/2012
EP 0992654 A2 4/2000
(Continued)

OTHER PUBLICATIONS

British Search Report issued in British Patent Application No. GB1311333.7 on Jan. 27, 2014.
(Continued)

*Primary Examiner* — Dwayne J White
*Assistant Examiner* — Peter T Hrubiec
(74) *Attorney, Agent, or Firm* — Oliff PLC

(57) ABSTRACT

A component for releasing a flow of material into an environment subject to periodic fluctuations in pressure, which has: a first surface that includes an inlet; a second surface that includes an outlet; a duct formed in the component and extending from the inlet to the outlet so, when the component is in use, a flow of material received at the inlet can flow along the duct to be released at the outlet into an environment subject to periodic fluctuations in pressure. The duct includes a constriction at which it decreases in cross-sectional area as it progresses from the inlet to the outlet. This can help reduce the variation in flow rate of material released at the outlet caused by the periodic fluctuations in pressure, and may help to avoid/reduce ingestion, when the component is in use. Preferably, the component is configured to form part of a gas turbine engine.

16 Claims, 7 Drawing Sheets

(51) Int. Cl.
*F01D 9/04* (2006.01)
*F01D 11/08* (2006.01)

(52) U.S. Cl.
CPC .. *F05D 2250/323* (2013.01); *F05D 2260/202* (2013.01)

(58) Field of Classification Search
CPC ..... F01D 11/04; F01D 11/10; F04D 29/526; F04D 29/545; F04D 29/547
See application file for complete search history.

(56) References Cited

U.S. PATENT DOCUMENTS

| | | | | |
|---|---|---|---|---|
| 6,354,795 | B1 | 3/2002 | White et al. | |
| 7,147,432 | B2 | 12/2006 | Lowe et al. | |
| 7,238,001 | B2 * | 7/2007 | Rushton | F01D 11/04 415/110 |
| 7,273,351 | B2 * | 9/2007 | Kopmels | F01D 5/186 416/97 R |
| 7,296,967 | B2 | 11/2007 | Shapiro | |
| 7,819,623 | B2 * | 10/2010 | Sutherland | F01D 11/24 415/116 |
| 8,550,774 | B2 * | 10/2013 | Maltson | F01D 5/225 415/116 |
| 2009/0297341 | A1 | 12/2009 | Turnquist et al. | |
| 2012/0020787 | A1 | 1/2012 | Krückels et al. | |
| 2012/0057961 | A1 | 3/2012 | Tibbott et al. | |

FOREIGN PATENT DOCUMENTS

| | | | |
|---|---|---|---|
| EP | 1655453 | A1 | 5/2006 |
| EP | 2 204 538 | A2 | 7/2010 |
| GB | 2 409 247 | A | 6/2005 |
| WO | WO 2012/052961 | A1 | 4/2012 |

OTHER PUBLICATIONS

Oct. 20, 2014 Search Report issued in European Application No. 14 17 3079.

* cited by examiner $ØD_1^2=(2 \pm 0.5)ØD_2^2$
$5° < \alpha < 90°$ $A_1=(2 \pm 0.5)A_2$
$5° < \alpha < 90°$

COMPONENT FOR USE IN RELEASING A FLOW OF MATERIAL INTO AN ENVIRONMENT SUBJECT TO PERIODIC FLUCTUATIONS IN PRESSURE

FIELD OF THE INVENTION

The present invention relates to a component for use in releasing a flow of material into an environment subject to periodic fluctuations in pressure. Preferably, the component is configured to form part of a gas turbine engine.

BACKGROUND OF THE INVENTION

It is common for a gas turbine engine to include a rotor shroud. The rotor shroud is typically located downstream of a high pressure vane ("HP vane") in the gas turbine engine, usually with a radially inner surface of the rotor shroud facing the unshrouded tips of the blades of a high pressure turbine ("HP turbine"). The rotor shroud is usually a ring shaped structure (or "annulus") and is typically formed from a plurality of arcuate segments mounted to a structural casing in the engine.

In use, the rotor shroud typically contains hot combustion gasses produced in a combustor of the gas turbine engine as those hot combustion gases pass through a rotor passage which contains the blades of the HP turbine. Consequently, the rotor shroud is typically subject to high heat loads, particularly at its radially inner surface. Moreover, the passing of the rotor tips typically imposes periodic pressure fluctuations of large amplitude on the radially inner surface of the rotor shroud.

Different cooling configurations have previously been proposed for the rotor shroud. A typical design uses an imperforate casing coated with a thermal barrier coating and an internal cooling circuit. Other designs utilise film cooling holes fed by cooling air, usually bled from a compressor in the gas turbine engine, via plenums within the arcuate segments of the rotor shroud, so as to film cool the radially inner surface of the rotor shroud immediately downstream of the HP vane and through the rotor passage.

Examples of film cooled rotor shrouds are described, for example, in U.S. Pat. No. 7,147,432, US2012/0057961, U.S. Pat. No. 7,296,967, U.S. Pat. No. 6,354,795, U.S. Pat. No. 6,196,792.

An example of a rotor shroud that uses a thermal barrier coating ("TBC") is described, for example, in U.S. Pat. No. 4,497,610.

An HP vane in a gas turbine engine is typically situated downstream of a combustor in the gas turbine engine. The HP vane is typically subjected to high heat loads due to its proximity to combustion gases. The HP vane is particularly difficult to cool since there is not usually adequate space for an internal cooling circuit to be placed at the tip of the trailing edge of the HP vane. The HP vane is also usually subjected to an unsteady pressure potential field generated by the downstream HP rotor. Typically cooling of the trailing edge of the HP vane is accomplished using a slot in the HP vane which is optimised for aerodynamic design rather than temporal control of the flow rate of cooling air through the slot.

The present inventor has observed that prior art rotor shroud cooling designs are typically subjected to large pressure fluctuations associated with the turbine rotor pressure field (the frequency of such fluctuations typically occur in the range 10-20 kHz, which corresponds to the typical passing frequency of the rotor blade tips). The present inventor has noticed that this unsteady pressure field causes large unsteady variations in ejected temporal coolant mass flow rate from the exit of the cooling holes onto the radially inner surface of the rotor shroud. In the rotor frame of reference, this typically results in a higher than average amount of coolant being ejected onto the rotor shroud surface local to the rotor suction surface and under the rotor tip when the time instantaneous pressure ratio across the holes is high. This flow is typically entrained into the rotor tip leakage vortex and subsequently has a limited cooling effect. Conversely in the region local to the rotor pressure surface less coolant is ejected onto the rotor shroud surface due to the lower instantaneous pressure ratio across the cooling holes. This is the region subjected to the largest heat loads and is therefore the region that it would be most beneficial to cool.

The present inventor has also observed that the unsteady nature of this process can lead to temporal ingestion within the film cooling holes local to the rotor pressure surface, even if the plenum pressures are set to exceed the maximum temporal exit pressure ratio. Without wishing to be bound by theory, the present inventor believes that this ingestion is caused by a sudden rise in film cooling hole exit pressure (resulting from the passing of the rotor tip), which sends a compression wave up the cooling hole, which in turn induces a change in the bulk coolant flow velocity within the hole, which can in some cases cause a bulk flow reversal within the hole leading to ingestion.

The present inventor believes that a similar mechanism exists for trailing edge slots in HP vanes. In this case, the pressure fluctuations are caused by an unsteady pressure potential field generated by the downstream HP rotor.

The present invention has been devised in light of the above considerations.

SUMMARY OF THE INVENTION

In a first aspect, the present invention may provide:

A component for use in a gas turbine engine for releasing a flow of cooling air into an environment subject to periodic fluctuations in pressure, the component having:

a first surface that includes an inlet;

a second surface that includes an outlet;

a duct that is formed in the component and extends from the inlet to the outlet so that, when the component is in use, a flow of material received at the inlet is able to flow along the duct to be released at the outlet into an environment subject to periodic fluctuations in pressure;

characterised in that: the duct includes an inlet region having length $L_1$ and flow area $A_1$ and an outlet region having $L_2$ with flow area $A_2$ and a constriction (36) at which the duct decreases in cross-sectional area as it progresses from the inlet region to the outlet region.

Advantageously, the inclusion of the constriction in the duct can help to reduce the variation in flow rate of material released at the outlet caused by the periodic fluctuations in pressure, and may further help to avoid/reduce ingestion, when the component is in use.

Optional features of the invention will now be set out. These are applicable singly or in any combination with any aspect of the invention.

The ratio of $L_1$ to $L_2$ may be provided by the relationship $L_1=(2\pm1)L_2$.

If the component is configured to form part of a gas turbine engine, the environment subject to periodic fluctuations in pressure may be a region within the gas turbine engine subject to periodic fluctuations in pressure caused by motion of rotor blades.

Preferably, the material is coolant, e.g. cooling air, for cooling the second surface, e.g. by a film cooling process. If the component is configured to form part of a gas turbine engine, the material is preferably cooling air bled from a compressor of the gas turbine engine. This may be particularly useful if the environment subject to periodic fluctuations in pressure is a region within the gas turbine engine subject to periodic fluctuations in pressure caused by the motion of rotor blades (see above), since in this case the second surface may be exposed to very high temperatures, e.g. caused by combustion gases from a combustor of the gas turbine engine.

Thus, in some embodiments, the first aspect of the invention may provide:

A component configured to form part of a gas turbine engine, wherein the component is for use in releasing a flow of cooling air into a region within the gas turbine engine subject to periodic fluctuations in pressure caused by motion of rotor blades, the component having:

a first surface that includes an inlet;

a second surface that includes an outlet;

a duct that is formed in the component and extends from the inlet to the outlet so that, when the component is in use, a flow of cooling air bled from a compressor of the gas turbine engine and received at the inlet is able to flow along the duct to be released at the outlet into a region within the gas turbine engine subject to periodic fluctuations in pressure caused by motion of rotor blades;

wherein the duct includes a constriction at which the duct decreases in cross-sectional area as it progresses from the inlet to the outlet.

A skilled person would appreciate that there are a number of components configured to form part of a gas turbine engine to which the present invention may be applied. Some of these possible components will now be discussed.

The component may be a rotor shroud for a gas turbine engine or an arcuate segment configured to form part of a rotor shroud in a gas turbine engine. In this case:

the first surface may be configured to receive a flow of coolant (e.g. cooling air) when the rotor shroud/arcuate segment is in use in a gas turbine engine; and/or the second surface may be configured to face the blades of a rotor when the when the rotor shroud/arcuate segment is in use in a gas turbine engine.

Here, the second surface (of the rotor shroud/arcuate segment) is preferably radially inwards of the first surface.

The component may be a guide vane for deflecting combustion gases in a gas turbine engine. In this case:

the first surface may be configured to receive a flow of coolant (e.g. cooling air) when the guide vane is in use in a gas turbine engine; and/or the second surface may be configured to deflect combustion gases when the guide vane is in use in a gas turbine engine.

Here, the first surface (of the guide vane) is preferably an internal surface of the guide vane and the second surface is preferably an external surface of the guide vane. Usually, a duct (e.g. hole or slot) in a HP vane is formed entirely in a wall of the guide vane with no additional parts.

The component may be a casing for an unshrouded rotor in a gas turbine engine or an arcuate segment configured to form part of a casing for an unshrouded rotor in a gas turbine engine. In this case:

the first surface may be configured to receive a flow of coolant (e.g. cooling air) when the casing/arcuate segment is in use in a gas turbine engine; and/or the second surface may be configured to face the unshrouded rotor blades of a turbine when the when the casing/arcuate segment is in use in a gas turbine engine.

Here, the second surface (of the casing/arcuate segment) is preferably radially inwards of the first surface.

A skilled person would appreciate that the duct may have a variety of different shapes and/or dimensions depending e.g. on design factors and intended application. Some possible shapes/dimensions will now be discussed.

The duct may have the form of a hole, e.g. a circular hole, that extends from the inlet to the outlet. A duct of this shape may be particularly suitable if the component is, for example, a rotor shroud, an arcuate segment configured to form part of such a rotor shroud, a casing for an unshrouded rotor in a gas turbine engine, or an arcuate segment configured to form part of such a casing.

The duct may have the form of a slot, e.g. having a generally rectangular shape. A duct of this shape may be particularly suitable if the component is, for example, a guide vane for deflecting combustion gases in a gas turbine engine.

The constriction in the duct may include a gradual tapering of the duct along at least a portion of the duct. The gradual tapering of the duct may include a tapering of the duct at an angle of convergence $\alpha$ relative to an axis extending from the inlet to the outlet.

The constriction in the duct may include a discontinuous step.

Herein, for brevity, a duct that includes a constriction may be viewed as being divided into an inlet region and an outlet region. The inlet region of the duct may be the region of the duct between the inlet and the point at which the duct reaches its smallest cross-section (as the duct progresses from the inlet to the outlet). The outlet region of the duct may be the region of the duct between the point at which the duct reaches its smallest cross-section (as the duct progresses from the inlet to the outlet) and the outlet.

Preferably, the dimensions/parameters of the duct are specifically chosen to reduce the variation in flow rate of material released at the outlet caused by the periodic fluctuations in pressure, when the component is in use.

Some dimensions/parameters of the duct that may be chosen to reduce the variation in flow rate of material released at the outlet caused by periodic fluctuations in pressure, when the component is in use, may include:

total length of the duct (which may be defined as $L=L_1+L_2$, where $L_1$ is the length of the inlet region and $L_2$ is the length of the outlet region)

ratio between $L_1$ and $L_2$ ratio between the area of the duct at the inlet (which may be defined as $A_1$) and the area of the duct at the outlet (which may be defined as $A_2$)

an angle of the convergence at which the duct tapers (which may be defined as a see above).

Equations may be defined to provide preferred ranges for such dimensions/parameters, which equations may, for a gas turbine engine, be expressed in terms of blade count (number of blades in a turbine), shaft speed (speed of turbine shaft) and sonic velocity of the coolant. Areas may be given as ratios of each other.

Preferably, $A_1^2=(2\pm0.5)A_2^2$, where $A_1$ is the area of the duct at the inlet and $A_2$ is the area of the duct at the outlet.

Thus, in the case that the duct is a circular hole of diameter $ØD_1$ at the inlet and of diameter $ØD_2$ at the outlet, it is preferable that $ØD_1^2=(2\pm0.5)ØD_2^2$.

Preferably, $5°<\alpha<90°$, where $\alpha$ is an angle of the convergence at which the duct tapers (see above).

Dimensions chosen according to the equations set out above have been found to result in improved reductions in the variation in flow rate of material released at the outlet caused by periodic fluctuations in pressure.

The duct may be substantially perpendicular to the first and/or second surface.

The duct may be inclined to both the first and second surfaces. This may be particularly suitable if the component is a casing for an unshrouded rotor in a gas turbine engine or an arcuate segment configured to form part of such a casing, for example.

In some embodiments, the duct may include multiple constrictions.

Preferably, the duct does not include any expansions at which the duct increases in cross-sectional area as it progresses from the inlet to the outlet, since the inclusion of such expansions may create unwanted pressure wave reflections that could increase the variation in flow rate of material released at the outlet caused by the periodic fluctuations in pressure, when the component is in use.

Of course, other duct shapes/orientations may equally be possible.

In a second aspect, the invention may provide a gas turbine engine including one or more components as set out in the first aspect of the invention.

For example, the gas turbine engine may include any one or more of the following components:

- a rotor shroud or a plurality of arcuate segments configured to form a rotor shroud as set out above, wherein the rotor shroud is for shrouding rotor blades of a turbine in the gas turbine engine;
- a guide vane as set out above, wherein the guide vane is for deflecting combustion gases in the gas turbine engine;
- a casing or a plurality of arcuate segments configured to form a casing as set out above, wherein the casing is for enclosing unshrouded rotor blades of a turbine in the gas turbine engine.

In a third aspect, the invention may provide:

A method of making a component for use in releasing a flow of material into an environment subject to periodic fluctuations in pressure, the method including:

providing a component that has a first surface and a second surface;

forming a duct in the component, the duct extending from an inlet included in the first surface of the component to an outlet included in the second surface of the component, wherein the duct includes a constriction at which the duct decreases in cross-sectional area as it progresses from the inlet to the outlet.

The component may be made to be a component having any feature described in connection with the first aspect of the invention.

In a fourth aspect, the invention may provide:

A method of modifying a component for use in releasing a flow of material into an environment subject to periodic fluctuations in pressure, the component having:

a first surface that includes an inlet;

a second surface that includes an outlet;

a duct that is formed in the component and extends from the inlet to the outlet so that, when the component is in use, a flow of material received at the inlet is able to flow along the duct to be released at the outlet into an environment subject to periodic fluctuations in pressure;

wherein the method includes forming a constriction in the duct at which the duct decreases in cross-sectional area as it progresses from the inlet to the outlet.

Forming the constriction in the duct may involve, for example, widening the duct along only a portion of the duct so as to form the constriction.

The component may be modified to be a component having any feature described in connection with the first aspect of the invention.

The invention also includes any combination of the aspects and preferred features described except where such a combination is clearly impermissible or expressly avoided.

Further optional features of the invention are set out below.

BRIEF DESCRIPTION OF THE DRAWINGS

Embodiments of the invention will now be described by way of example with reference to the accompanying drawings in which:

FIG. 5(*b*) shows a cooling hole arrangement including a plurality of ducts having the form of the inclined shaped cooling holes of FIG. 5(*a*) in a segment of an unshrouded rotor casing, as viewed from the outer radial surface of the segment (which contains inlets which are smaller than outlets).

FIG. 6(*b*) shows the trailing edge slot of FIG. 6(*a*), as viewed from a pressure side.

DETAILED DESCRIPTION AND FURTHER OPTIONAL FEATURES OF THE INVENTION

Figure 1:
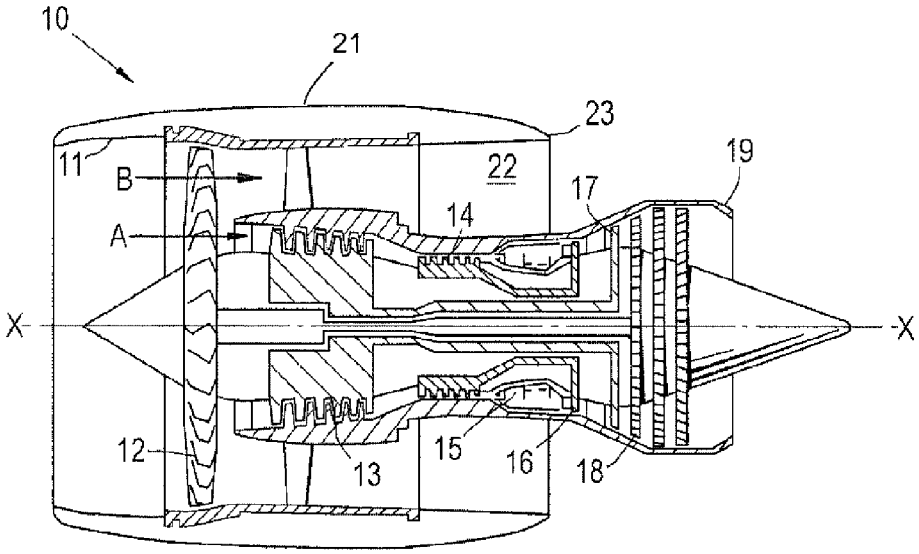
FIG. 1 shows a ducted fan gas turbine engine.

In general, the following discussion describes examples of our proposals that preferably use the properties of pressure wave reflections to control the flow rate of cooling air released at an outlet into an environment subject to periodic fluctuations in pressure. Without wishing to be bound by theory, these examples preferably use a property that when a pressure wave propagates through a duct with an increase in cross-sectional area (relative to the direction of propagation of the wave), a pressure wave of negative amplitude is reflected and a pressure wave of increased positive amplitude is transmitted. For this description, a passage formed in a component that extends from an inlet to an outlet is referred to as a duct.

The examples preferably use both the reflection and transmission properties of pressure waves in a duct to regulate the flow rate of coolant (e.g. cooling air) released at an outlet. In some embodiments, a duct (which may have the form of a cooling hole or slot) includes a constriction at which the duct decreases in cross-sectional area as it progresses from the inlet to the outlet. Thus, the inlet may have a larger cross sectional area than the outlet. An increase in pressure at the outlet, e.g. caused by the passing of a rotor tip in the vicinity of the outlet; may cause a pressure wave to propagate along the duct from the outlet towards the inlet. The pressure wave thus preferably observes an increase in duct cross sectional area at the constriction, as it propagates along the duct towards the inlet. Without wishing to be bound by theory, it is believed that this will generate a reflected expansion pressure wave back down the outlet region of the duct (i.e. towards the outlet) which preferably acts to temporarily increase the bulk coolant flow velocity in the direction of the outlet, thereby leading to a temporary increase in the flow rate of coolant (e.g. measured in units of mass per unit time) released at the outlet at a time that is approximately $2aL_2$ after the increase in outlet static pressure where a is the speed of sound within the coolant and $L_2$ is the length of the outlet region. Again, without wishing to be bound by theory, it is believed that the transmitted pressure wave will be amplified by the change in area at the constriction and will propagate up the inlet region of the duct (i.e. towards the inlet), which will in turn will act to increase the pressure in the inlet region of the duct (e.g. above a plenum feed pressure). Preferably, this action temporarily increases the pressure ratio between the inlet and outlet regions of the duct (in which case, the inlet region could be thought of as acting as a small plenum) which may in turn serve to further increase the flow rate of coolant released at the outlet.

To achieve a duct having the above properties, the inlet would typically be larger (in cross-sectional area) than the outlet. This could be achieved with the duct having the form of a cylindrical hole including one or more discontinuous (non-tapered) steps, a conically stepped hole, or indeed with any hole which has a controlled decrease in area from the inlet to the outlet. If the component were a guide vane, such as a HP vane, the duct may provide or form part of a "trailing edge slot" of the HP vane. The trailing edge slot may include one or more wide slots. In one example, a trailing edge of the guide slot could include only one slot whose outlet would preferably have a smaller cross-sectional area than its inlet. This change in area could be achieved with a stepped slot, with one or multiple steps, with a tapered stepped slot, or with any slot which has a controlled decrease in area from the inlet to the outlet. Alternatively the trailing edge slot could include a plurality of cylindrical holes, each of which may be larger at inlet than at outlet. This change in area could be achieved with a stepped cylindrical hole, with one or multiple steps, with a conically stepped hole, or with any hole which has a controlled decrease in area from the inlet to the outlet. This arrangement may be suitable for guide vanes that are in vane rows with small vane/rotor gaps where the pressure fluctuation may be significant.

With reference to FIG. 1, a ducted fan gas turbine engine that may incorporate the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle (casing) 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Figure 2:
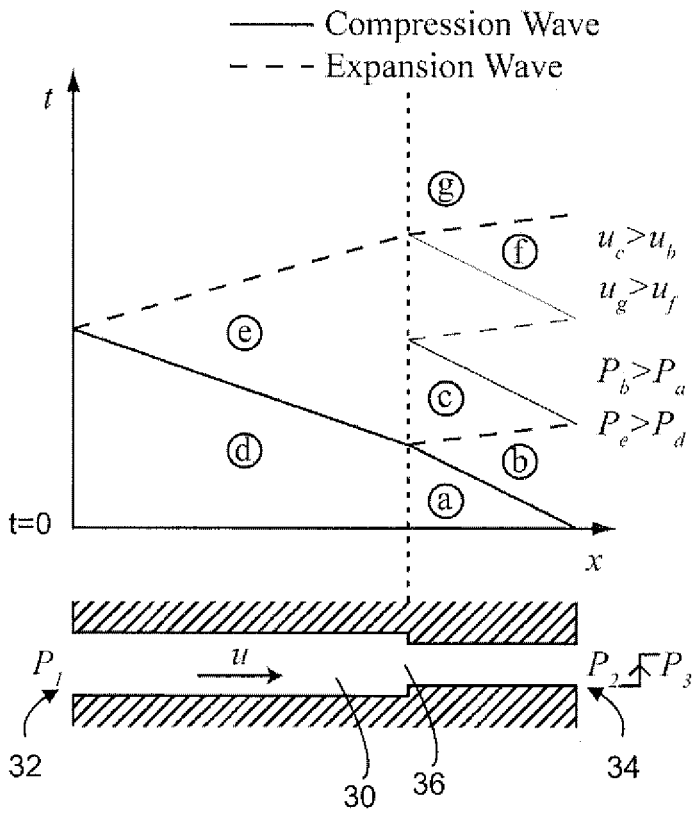
FIG. 2 illustrates the propagation of pressure waves within a duct having the form of a stepped cooling hole.

FIG. 2 illustrates the propagation of pressure waves within a duct having the form of a stepped cooling hole 30.

At t=0 in FIG. 2, an increase in pressure at an outlet 34 (e.g. caused by the passing of a rotor blade, not shown) causes a compression wave (solid line in FIG. 2) to propagate up the cooling hole towards an inlet 32. At the constriction 36 (which, to the compression wave, is an increase in hole area), an expansion wave (dashed line in FIG. 2) is reflected back towards the outlet 34 and a weaker compression wave continues to propagate towards the inlet 32. The coolant behind this expansion wave (region c) is travelling at a greater velocity than that ahead in region b. This generates a temporary increase in the rate of coolant released at the outlet.

Note that the region behind the propagating compression wave (region e) is at a higher pressure than was previously the case (region d). This results in an increase in the instantaneous pressure ratio across the outlet region of the cooling hole 30, thereby generating a further temporary increase in the rate of coolant released at the outlet. It also acts to reduce the chance of ingestion by the cooling hole 30. A yet further temporary increase in the rate of coolant released at the outlet may be observed when the expansion wave reflected from the hole inlet interacts with the hole exit.

Figure 3A:
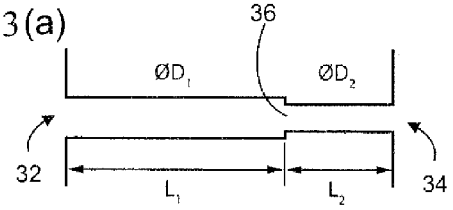
FIG. 3(*a*)-(*d*) illustrate a plurality of different possible duct geometries.
Figure 3:
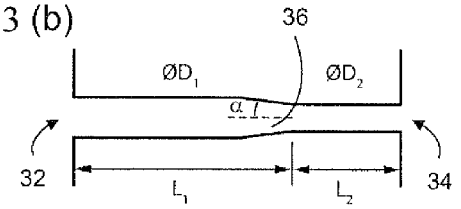
Figure 3:
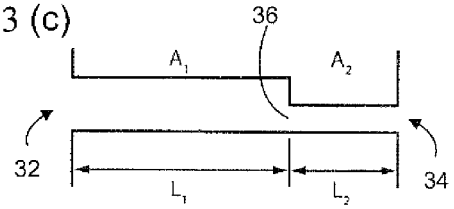
Figure 3:
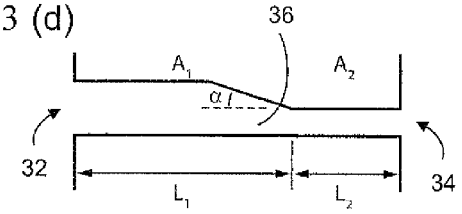

FIG. 3(*a*)-(*d*) illustrate a plurality of different possible duct geometries.

In FIG. 3(*a*) the duct is a "stepped hole", in which the duct has the form of a circular hole that extends from the inlet 32 to the outlet 34, wherein the constriction 36 includes a discontinuous step.

In FIG. 3(*b*) the duct is a "conically stepped hole", in which the duct has the form of a circular hole that extends from the inlet 32 to the outlet 34, wherein the constriction 36 includes a conical gradual tapering of the hole at an angle of convergence $\alpha$ relative to an axis extending from the inlet 32 to the outlet 34.

In FIG. 3(*a*) and FIG. 3(*b*), the inlet region has a length $L_1$ and a diameter $ØD_1$ at its widest; the outlet region has a length $L_2$ and a diameter $ØD_2$. In FIG. 3(*b*), the angle of convergence relative to an axis extending from the inlet 32 to the outlet 34 is labelled $\alpha$. Some preferred values for these parameters are shown in FIG. 3.

In FIG. 3(*c*) the duct is a "stepped slot", in which the duct has the form of a slot that extends from the inlet 32 to the outlet 34, wherein the constriction 36 includes a discontinuous step.

In FIG. 3(*d*) the duct is of a "stepped slot", in which the duct has the form of a slot that extends from the inlet 32 to the outlet 34, wherein the constriction 36 includes a gradual tapering of the slot at angle of convergence α relative to an axis extending from the inlet 32 to the outlet 34.

In FIG. 3(*c*) and FIG. 3(*d*), the inlet region has a length $L_1$ and a cross-sectional area $A_1$ at its widest; the outlet region has a length $L_2$ and an area $A_2$ at its widest. In FIG. 3(*d*), the angle of convergence relative to an axis extending from the inlet 32 to the outlet 34 is labelled α. Some preferred values for these parameters are shown in FIG. 3.

The time taken for a pressure wave to propagate from the duct outlet region, reflect from the inlet region and return to the outlet region $t_{reflect}$ may be given by:

$$t_{reflect}=2(L_1+L_2)/a_{0,c}$$

Where $a_{0,C}$ is the sonic velocity of the material (e.g. coolant).

For the preferred applications discussed herein, the unsteady pressure at the duct outlet generally has a period equal to that of the HP rotor blade passing period. In order to minimise the temporal reduction in mass flow rate from the duct outlet occurring after a rise in duct outlet pressure, it is preferable for the reflected pressure waves generated by this event to interact with the outlet in a time given by:

$$t_{reflect}=2\pi(0.3\pm0.15)/N\omega$$

Where N is the number of rotor blades included in the rotor causing the periodic fluctuations in pressure (which may be the HP rotor), and ω is the angular frequency of that rotor (rad/s).

With regard to the application of a duct located on the casing of an HP rotor, this corresponds to a short time after the passing of the rotor tip and before the arrival of rotor blade mid passage. Hence a preferred total length of the duct can be calculated from:

$$N\omega(L_1+L_2)/\pi a_{0,c}=0.3\pm0.15$$

The ratios of $L_1$ and $L_2$ are then preferably chosen to ensure that the pressure wave reflection from the duct constriction and duct inlet region minimises the temporal mass flow rate from the duct outlet region. This may correspond to a range of:

$$L_1=(2\pm1)L_2$$

The duct areas are preferably selected such that approximately half the energy in the pressure wave is reflected at the constriction.

$$ØD_1^2=(2\pm0.5)ØD_2^2$$

$$A_1^2=(2\pm0.5)A_2^2$$

The taper angle alters the duration of the reflected pressure wave from the constriction and is preferably chosen such that:

$$5°<\alpha<90°$$

As can be seen from the above discussion, the invention may use hole shaping to control pressure reflections to control the temporal variation of mass flow rate through a hole.

Figure 4:
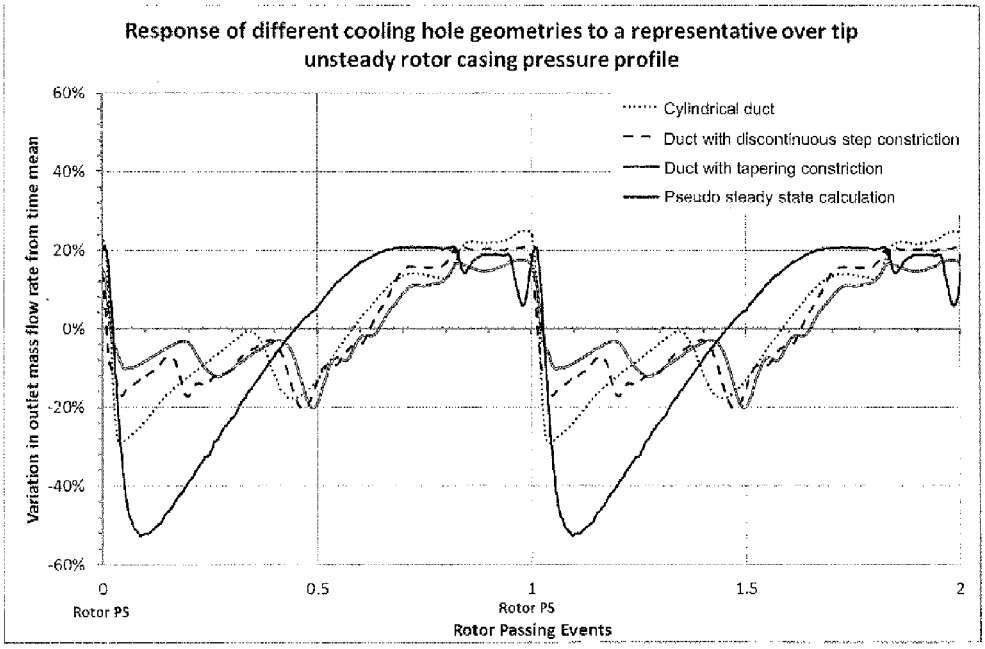
FIG. 4 illustrates the response of different duct geometries to a representative over tip unsteady rotor shroud pressure profile.

Some potential benefits of using a stepped or conically stepped cooling hole design are illustrated by FIG. 4.

To produce the graph shown in FIG. 4, a simulation was performed in which the inlet to a duct having the form of a cooling hole was maintained at a constant total pressure whilst the outlet was subjected to an unsteady pressure profile representative of that which may be present at a rotor shroud.

The pseudo state result was calculated using a time instantaneous isentropic flow calculation. The pseudo state result represents what the hole outlet mass flow rate would be if there were no unsteady pressure wave effects within the hole. To obtain this result, a steady state isentropic mass flow rate calculation was performed at each time step based on the pressure ratio at that time step.

By inspecting FIG. 4, the effects of the pressure wave interactions are evident on all of the hole geometries. The stepped and conically stepped holes show a reduction in the peak to peak unsteady mass flow rate (flow rate of material released at the outlet), and more critically a lower reduction in mass flow rate local to the rotor pressure surface where coolant is most required.

Thus, by using the invention, max to min variations in mass flow rate can be reduced which may allow gas turbine engine components to operate closer to their optimum mass flow rate over the whole temporal variation of the rotor passing cycle. Further, ingestion can be reduced or eliminated for cooling holes operating at low pressure margins.

Figure 5:
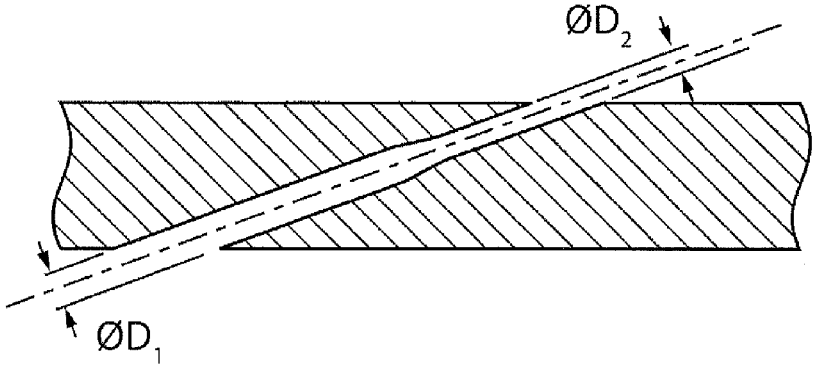
FIG. 5(*a*) shows a duct having the form of an inclined shaped cooling hole in a segment of an unshrouded rotor casing, as viewed in cross-section.
Figure 5:
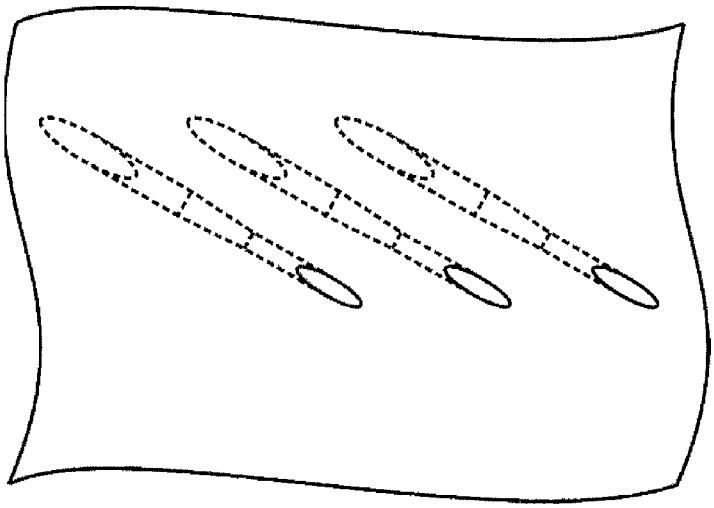

One application of the invention is for the film cooling holes in an arcuate segment configured to form part of a casing for an unshrouded rotor. In this case the holes would preferably be inclined to the surface, e.g. as illustrated by FIG. 5(*a*) and FIG. 5(*b*).

Figure 6:
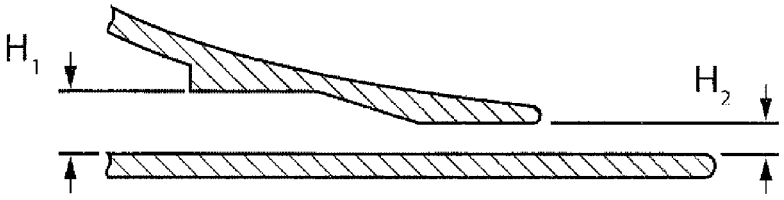
FIG. 6(*a*) shows a duct having the form of a trailing edge slot in which a change of cross-sectional area is achieved by varying slot height, as viewed in cross section.
Figure 6:
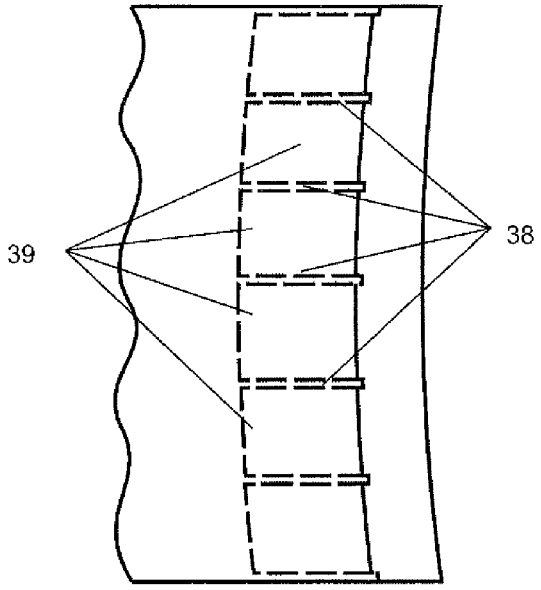

For application in a trailing edge slot, the change in area could be formed by altering the height of the slot, see e.g. FIG. 6(*a*) and FIG. 6(*b*).

A trailing edge slot would typically include a plurality of webs 38 so as to maintain the structural integrity of the slot. The webs may divide the slot into a plurality of segments 39, each of which can be viewed as a respective duct, e.g. with the slot being viewed as a composite duct.

In the case of FIG. 6, the webs 38 in the trailing edge slot are of uniform width/thickness (see e.g. FIG. 6(*b*)).

Figure 7:
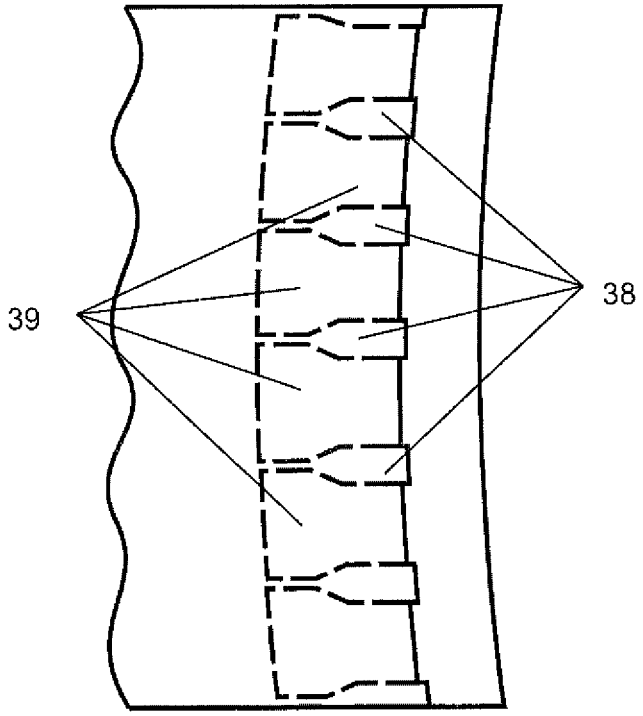
FIG. 7 shows a duct having the form of a trailing edge slot arrangement in which a change of cross-sectional area is achieved by a variable web thickness, as viewed from a pressure side.

However, the change in area in a trailing edge slot could also be achieved by altering the width/thickness of the webs between the slots, see e.g. FIG. 7. Note that varying the width/thickness of the webs 38 as shown in FIG. 7 could be done in addition to altering the height of the slot as shown in FIG. 6, e.g. to achieve a desired ratio between the area of the duct at the inlet (which may be defined as $A_1$) and the area of the duct at the outlet (which may be defined as $A_2$).

While the invention has been described in conjunction with the exemplary embodiments described above, many equivalent modifications and variations will be apparent to those skilled in the art when given this disclosure. For example, the invention could be applied in any field in which there is a significant temporal variation in pressure at the exit of a mass flow controlling hole where: 1) It is desired to control the temporal fluctuation in mass flow rate through the hole; 2) the fluctuation in external pressure occurs with a characteristic repeat period (1/f) which is of the same order of magnitude as the transit time of a pressure wave from one end of the controlling hole to the other. For example, the same physical processes (pressure waves reflection and propagation) behind this invention caused to design the inlet and exhaust manifolds of internal combustion engines.

Accordingly, the exemplary embodiments of the invention set forth above are considered to be illustrative and not limiting. Various changes to the described embodiments may be made without departing from the spirit and scope of the invention.

For the avoidance of any doubt, the theoretical explanations provided herein, e.g. with reference to FIG. 2, are provided for the purposes of improving the understanding of a reader. The inventors do not wish to be bound by any of these theoretical explanations.

All references referred to above are hereby incorporated by reference.

The invention claimed is:

1. A component configured for use in a gas turbine engine for releasing a flow of cooling air into an environment subject to periodic fluctuations in pressure, the component having:

a first surface that includes an inlet;

a second surface that includes an outlet;

a duct that is formed in the component and extends from the inlet to the outlet so that, when the component is in use, a flow of material received at the inlet is able to flow along the duct to be released at the outlet into an environment subject to periodic fluctuations in pressure;

wherein: the duct includes an inlet region having length $L_1$ and flow area $A_1$ and an outlet region having length $L_2$ with flow area $A_2$ and a constriction at which the duct decreases in cross-sectional area as it progresses from the inlet region to the outlet region, wherein $A_1^2=(2\pm0.5)A_2^2$, where $A_1$ is the area of the duct at the inlet and $A_2$ is the area of the duct at the outlet.

2. A component according to claim 1, wherein the ratio of $L_1$ to $L_2$ is provided by the relationship $L_1=(2\pm1)L_2$.

3. A component according to claim 2, wherein:

the environment subject to periodic fluctuations in pressure is a region within the gas turbine engine subject to periodic fluctuations in pressure caused by motion of rotor blades;

the material is cooling air bled from a compressor of the gas turbine engine.

4. A component according to claim 1, wherein the component is a rotor shroud for a gas turbine engine or an arcuate segment configured to form part of a rotor shroud in a gas turbine engine.

5. A component according to claim 1, wherein the component is a guide vane for deflecting combustion gases in a gas turbine engine.

6. A component according to claim 1, wherein the component is a casing for an unshrouded rotor in a gas turbine engine or an arcuate segment configured to form part of a casing for an unshrouded rotor in a gas turbine engine.

7. A component according to claim 1, wherein the duct has the form of a hole.

8. A component according to claim 1, wherein the duct has the foul of a slot.

9. A component according to claim 1, wherein the constriction in the duct includes a gradual tapering of the duct along at least a portion of the duct.

10. A component according to claim 1, wherein the constriction in the duct includes a discontinuous step.

11. A component according to claim 1, wherein $5°<\alpha<90°$, where $\alpha$ is an angle of the convergence at which the duct tapers.

12. A gas turbine engine including one or more components as set out in claim 1.

13. A component according to claim 1, wherein the flow area of the inlet prior to the constriction is constant.

14. A component according to claim 13, wherein the flow area of the outlet is constant.

15. A component according to claim 1, wherein the inlet region upstream of the constriction is cylindrical.

16. A component according to claim 15, wherein the outlet region is cylindrical.

* * * * *